US011446192B2

(12) United States Patent
Leiker et al.

(10) Patent No.: US 11,446,192 B2
(45) Date of Patent: Sep. 20, 2022

(54) TWO PIECE SUBJECT SUPPORT APPARATUSES

(71) Applicant: Liko Research & Development AB, Luleå (SE)

(72) Inventors: William Leiker, Jamesville, NY (US); Jessica Cushman, Cato, NY (US); Henrik Nyström, Luleå (SE); Anders Eriksson, Luleå (SE); Daniel Johansson, Råneå (SE)

(73) Assignee: Liko Research & Development AB, Luleå (SE)

( * ) Notice: Subject to any disclaimer, the term of this patent is extended or adjusted under 35 U.S.C. 154(b) by 0 days.

(21) Appl. No.: 16/851,425

(22) Filed: Apr. 17, 2020

(65) Prior Publication Data

US 2020/0330305 A1 Oct. 22, 2020

Related U.S. Application Data

(60) Provisional application No. 62/836,101, filed on Apr. 19, 2019.

(51) Int. Cl.
*A61G 7/10* (2006.01)

(52) U.S. Cl.
CPC ..... *A61G 7/1015* (2013.01); *A61G 7/109* (2013.01); *A61G 7/1042* (2013.01); *A61G 7/1051* (2013.01); *A61G 7/1055* (2013.01); *A61G 7/1059* (2013.01); *A61G 7/1086* (2013.01)

(58) Field of Classification Search
CPC .... A61G 7/1051; A61G 7/015; A61G 7/1061; A61G 2200/36; A61H 3/008; A61H 2201/1652
See application file for complete search history.

(56) References Cited

U.S. PATENT DOCUMENTS

| | | | | |
|---|---|---|---|---|
| 2,327,671 A * | 8/1943 | Rupprecht | ..... | A61H 3/04 280/87.021 |
| 4,903,355 A | 2/1990 | Hickerson | | |
| 4,905,989 A * | 3/1990 | Colvin | ..... | A61H 3/008 128/874 |
| 4,941,497 A * | 7/1990 | Prather | ..... | A61H 3/008 135/67 |

(Continued)

FOREIGN PATENT DOCUMENTS

| | | |
|---|---|---|
| EP | 1496829 B1 | 1/2005 |
| FR | 2861584 | 4/2006 |

(Continued)

*Primary Examiner* — Peter M. Cuomo
*Assistant Examiner* — Adam C Ortiz
(74) *Attorney, Agent, or Firm* — Dinsmore & Shohl LLP

(57) ABSTRACT

A subject support apparatus includes an upper portion and a lower portion. The upper portion includes a vest having a first end and a second end, a closure mechanism configured to couple the first end of the vest to the second end of the vest from a bottom end of the vest to a top end of the vest to form a closed loop, and a pair of shoulder straps extending from the vest. The lower portion includes a seat piece having a first end and a second end, and a pair of loop straps extending from the first end and the second end of the seat piece. Subject support systems including the subject support apparatus and methods of lifting a subject using the subject support apparatus are also described.

15 Claims, 5 Drawing Sheets

(56) References Cited

U.S. PATENT DOCUMENTS

| | | | | |
|---|---|---|---|---|
| 6,715,167 | B2 | 4/2004 | Wake | |
| 9,420,832 | B2 | 8/2016 | Arnold | |
| 2016/0367429 | A1* | 12/2016 | Dolce ..... | A61H 3/008 |

FOREIGN PATENT DOCUMENTS

| | | | |
|---|---|---|---|
| JP | 2003038584 | A | 2/2003 |
| KR | 101454075 | B1 | 11/2014 |

* cited by examiner

TWO PIECE SUBJECT SUPPORT APPARATUSES

CROSS-REFERENCE TO RELATED APPLICATIONS

This application claims the benefit of and priority to U.S. Provisional Application Ser. No. 62/836,101, titled "Two Piece Subject Support Apparatuses," filed Apr. 19, 2019, the entire contents of which is hereby incorporated by reference herein.

BACKGROUND

Field

The present specification generally relates to subject support apparatuses, and more particularly to two piece subject support apparatuses including an upper portion to support the torso of a subject and a lower portion to support the lower body of the subject.

Technical Background

Person lifting devices, such as mobile lifts and/or overhead lifts, may be used in hospitals, other health care facilities, and sometimes in home care settings to move a subject or assist in moving a subject from one location to another. Conventional lifting devices are coupled to a subject support apparatus that supports and engages the subject. Such conventional support apparatuses may include a variety of straps and loops that must be coupled in a specific way to a lift mechanism in order to properly lift the subject. However, the coupling of the straps and loops are not always intuitive for a caregiver, and can require a significant period of time to properly position the subject support apparatus around the subject. Accordingly, caregivers may attempt to lift the subject without a subject support apparatus because of the time and effort required with properly setting up the subject support apparatus.

Accordingly, a need exists for alternative subject support apparatuses that simplify the coupling of the subject support apparatus to a lift mechanism.

SUMMARY

In a first aspect, a subject support apparatus comprises an upper portion and a lower portion. The upper portion comprises a vest having a first end and a second end, a closure mechanism configured to couple the first end of the vest to the second end of the vest from a bottom end of the vest to a top end of the vest to form a closed loop, and a pair of shoulder straps extending from the vest. The lower portion comprises a seat piece having a first end and a second end, and a pair of loop straps extending from the first end and the second end of the seat piece.

In a second aspect, the subject support apparatus comprises the subject support apparatus of the first aspect, wherein the lower portion does not couple to the upper portion.

In a third aspect, the subject support apparatus comprises the subject support apparatus of any of the previous aspects, wherein the closure mechanism comprises a zipper.

In a fourth aspect, the subject support apparatus comprises the subject support apparatus of any of the previous aspects, wherein each of the pair of the loop straps is non-releasably coupled to the seat piece of the subject support apparatus.

In a fifth aspect, the subject support apparatus comprises the subject support apparatus of any of the previous aspects, wherein the upper portion is free of straps extending from the first end of the vest and/or the second end of the vest.

In a sixth aspect, a subject support system comprises the subject support apparatus of any of the previous aspects, a sling bar comprising at least two hooks to receive the pair of shoulder straps and the pair of loop straps, and a lift mechanism coupled to the sling bar.

In a seventh aspect, a subject support system comprises a subject support apparatus, sling bar, and a lift mechanism coupled to the sling bar. The subject support apparatus comprises an upper portion and a lower portion. The upper portion of the subject support apparatus comprises a vest having a first end and a second end; a closure mechanism configured to couple the first end of the vest to the second end of the vest to form a closed loop; and a pair of shoulder straps extending from the vest. The lower portion of the subject support apparatus comprises a seat piece having a first end and a second end, and a pair of loop straps extending from the first end and the second end of the seat piece. The sling bar comprising at least two hooks to receive the pair of shoulder straps and the pair of loop straps.

In an eighth aspect, the subject support system comprises the subject support system of the seventh aspect, wherein the lower portion does not couple to the upper portion.

In a ninth aspect, the subject support system comprises the subject support system of the seventh aspect, wherein the lower portion releasably couples to the upper portion.

In a tenth aspect, the subject support system comprises the subject support system of any of the seventh through ninth aspects, wherein the closure mechanism comprises a zipper.

In an eleventh aspect, the subject support system comprises the subject support system of any of the seventh through tenth aspects, wherein the upper portion is free of straps extending from the first end of the vest and/or the second end of the vest.

In a twelfth aspect, a method of lifting a subject comprises positioning the subject support apparatus of any of the first through fifth aspects around the subject; coupling the pair of shoulder straps of the upper portion of the subject support apparatus and the pair of loop straps of the lower portion of the subject support apparatus to a lift mechanism; and activating the lift mechanism to lift the subject.

In a thirteenth aspect, a method of lifting a subject comprises positioning an upper portion of a subject support apparatus around a torso of the subject, the upper portion comprising a vest having a first end and a second end, a closure mechanism configured to couple the first end of the vest to the second end of the vest to form a closed loop around the torso of the subject, and a pair of shoulder straps extending from the vest; positioning a seat portion of a lower portion of the subject support apparatus between legs of the subject and a surface upon which the subject is disposed, wherein the seat portion comprises a first end and a second end, and the lower portion further comprises a pair of loop straps extending from the first end and the second end of the seat piece; coupling the pair of shoulder straps of the upper portion of the subject support apparatus and the pair of loop straps of the lower portion of the subject support apparatus to a lift mechanism; and activating the lift mechanism to lift the subject.

In a fourteenth aspect, a method of lifting a subject comprises the method of the thirteenth aspect, wherein the lower portion of the subject support apparatus does not couple to the upper portion of the subject support apparatus.

In a fifteenth aspect, a method of lifting a subject comprises the method of the thirteenth aspect, wherein the lower portion of the subject support apparatus releasably couples to the upper portion of the subject support apparatus.

In a sixteenth aspect, a method of lifting a subject comprises the method of any of the thirteenth through fifteenth aspects, wherein the closure mechanism comprises a zipper.

In a seventeenth aspect, a method of lifting a subject comprises the method of any of the thirteenth through sixteenth aspects, wherein the upper portion of the subject support apparatus is free of straps extending from the first end of the vest and/or the second end of the vest.

In an eighteenth aspect, a method of lifting a subject comprises the method of any of the thirteenth through seventeenth aspects, wherein each of the pair of the loop straps is non-releasably coupled to the seat piece of the subject support apparatus.

In a nineteenth aspect, a method of lifting a subject comprises the method of any of the thirteenth through eighteenth aspects, wherein the lower portion of the subject support apparatus does not encircle the thighs of the subject.

Additional features of subject support apparatuses described herein will be set forth in the detailed description which follows, and in part will be readily apparent to those skilled in the art from that description or recognized by practicing the embodiments described herein, including the detailed description which follows, the claims, as well as the appended drawings.

It is to be understood that both the foregoing general description and the following detailed description describe various embodiments and are intended to provide an overview or framework for understanding the nature and character of the claimed subject matter. The accompanying drawings are included to provide a further understanding of the various embodiments, and are incorporated into and constitute a part of this specification. The drawings illustrate the various embodiments described herein, and together with the description serve to explain the principles and operations of the claimed subject matter.

DETAILED DESCRIPTION

Figure 1:
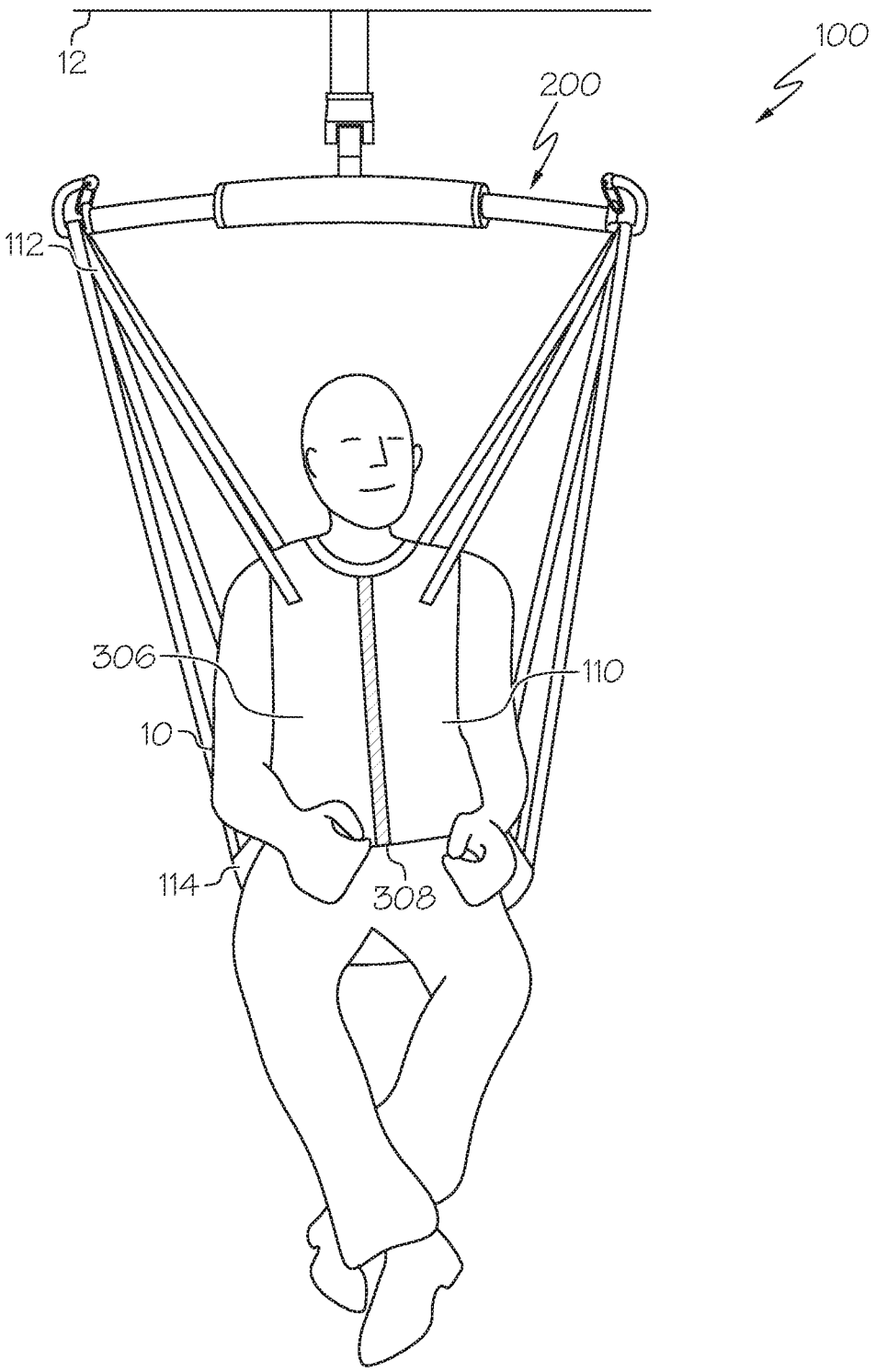
FIG. 1 schematically depicts a subject support system according to one or more embodiments shown and described herein.

Reference will now be made in detail to embodiments of subject support systems, examples of which are illustrated in the accompanying drawings. Whenever possible, the same reference numerals will be used throughout the drawings to refer to the same or like parts. In one embodiment, a subject support apparatus includes an upper portion comprising a vest and a closure mechanism configured to couple a first end of the vest to a second end of the vest from a bottom end of the vest to a top end of the vest, and a lower portion comprising a seat piece having a first end and a second end. Without being bound by theory, the vest may enable a caregiver to easily and correctly position the upper portion of the subject support apparatus around a torso of the subject while the lower portion of the subject support apparatus may be easily positioned between the thighs of the subject and a surface upon which the subject is disposed for supporting a lower portion of the subject. Various embodiments of subject support apparatuses and subject support systems including such subject support apparatuses will be described herein with specific reference to the appended drawings.

Subject Support Apparatuses

Figure 2:
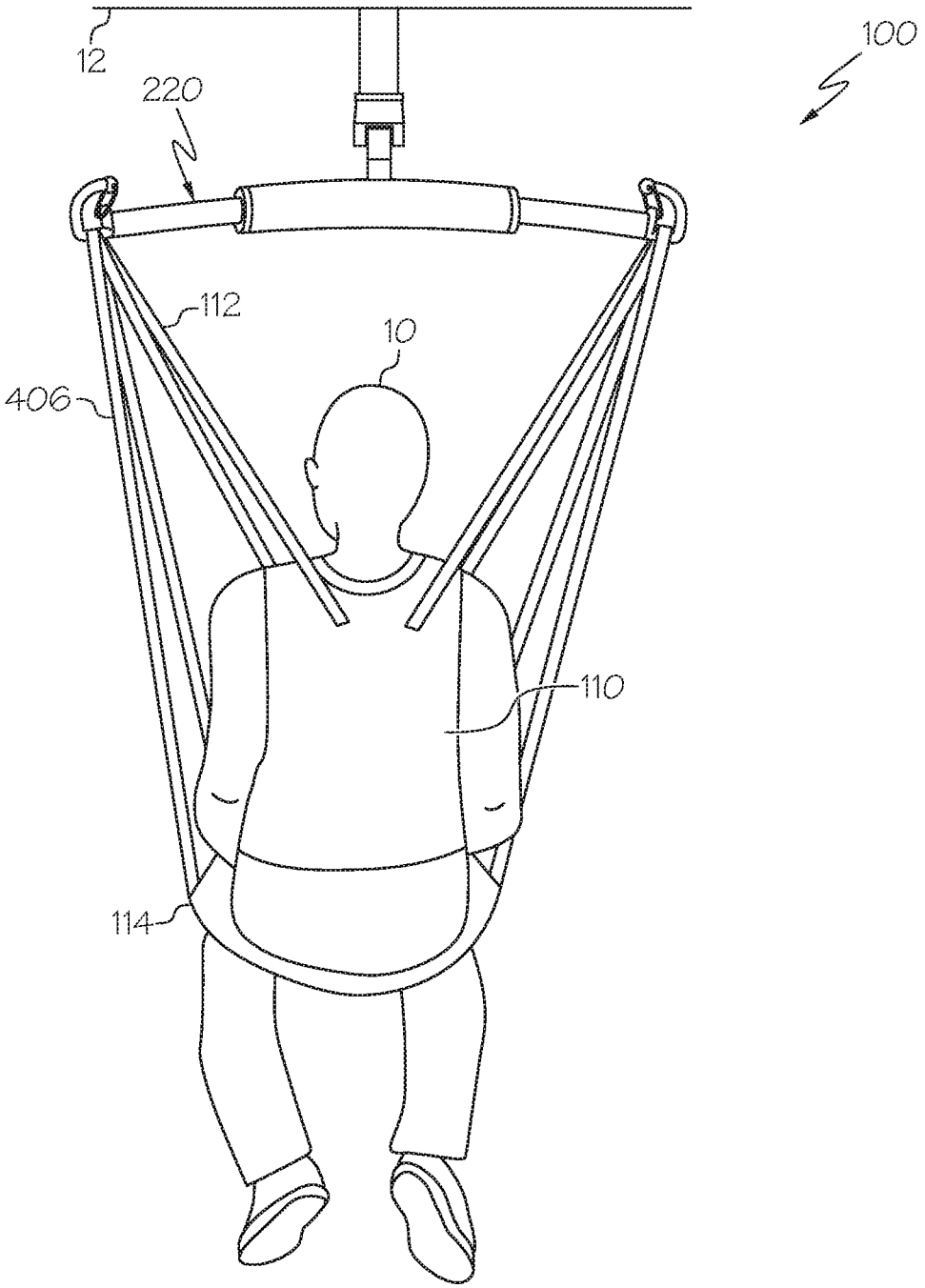
FIG. 2 schematically depicts an alternative view of the subject support system shown in FIG. 1 according to one or more embodiments shown and described herein.

Referring to FIGS. 1 and 2, a subject 10 is positioned in a subject support apparatus 100. The subject support apparatus 100 includes an upper portion 110 and a lower portion 114. The upper portion 110 includes a vest 306, a closure mechanism 308, and a pair of shoulder straps 112 extending from the vest 306. The closure mechanism 308 is configured to couple a first end of the vest 306 to a second end of the vest 306 from a bottom end of the vest to a top end of the vest to form a closed loop around the subject 10. In particular, when the first end of the vest is coupled to the second end of the vest, the vest 306 includes two arm holes through which the subject's arms extend, a neck hole through which the neck and head of the subject extend, and a bottom opening through which the waist and lower body of the subject extend.

In the embodiment depicted in FIGS. 1 and 2, the lower portion 114 of the subject support apparatus 100 is positioned under the thighs of the subject 10, supporting the lower body of the subject 10. The lower portion 114 generally includes a seat piece 400 and a pair of loop straps 406 extending from the seat piece 400. In various embodiments described herein, the lower portion 114 of the subject support apparatus 100 does not couple to the upper portion 110 of the subject support apparatus 100, and the two pieces remain as two distinct pieces during use. By not coupling the upper portion 110 and the lower portion 114 of the subject support apparatus 100 to one another, the number of straps and buckles included on the subject support apparatus 100 may be reduced, thereby simplifying the design and operation of the subject support apparatus 100. However, it is contemplated that, in some particular embodiments, the lower portion 114 may be coupled to the upper portion 110 of the subject support apparatus 100, as will be described in greater detail below.

As shown in FIGS. 1 and 2, the subject support apparatus 100 is coupled to a sling bar 200 by looping the shoulder straps 112 and the loop straps 406 over hooks of the sling bar 200, as will be described in greater detail below. The subject support apparatus 100 is selectively coupled to the sling bar 200 such that the subject support apparatus 100 is removable from the sling bar 200, and different subject support apparatuses may be coupled to the sling bar 200.

The sling bar 200 is coupled to an overhead structure 12. In embodiments, the overhead structure 12 may include a ceiling, an overhead beam, a mobile lift, or the like. By coupling the subject support apparatus 100 to the overhead structure 12 through the sling bar 200, some or all of the bodyweight of the subject 10 may be supported by the overhead structure 12, which may assist the caregiver in moving or repositioning the subject 10. Sling bars 200 as well as overhead structures 12 are described in greater detail below.

Having generally described the subject support apparatus 100, the upper portion 110 and the lower portion 114 will now be described in greater detail.

Figure 3A:
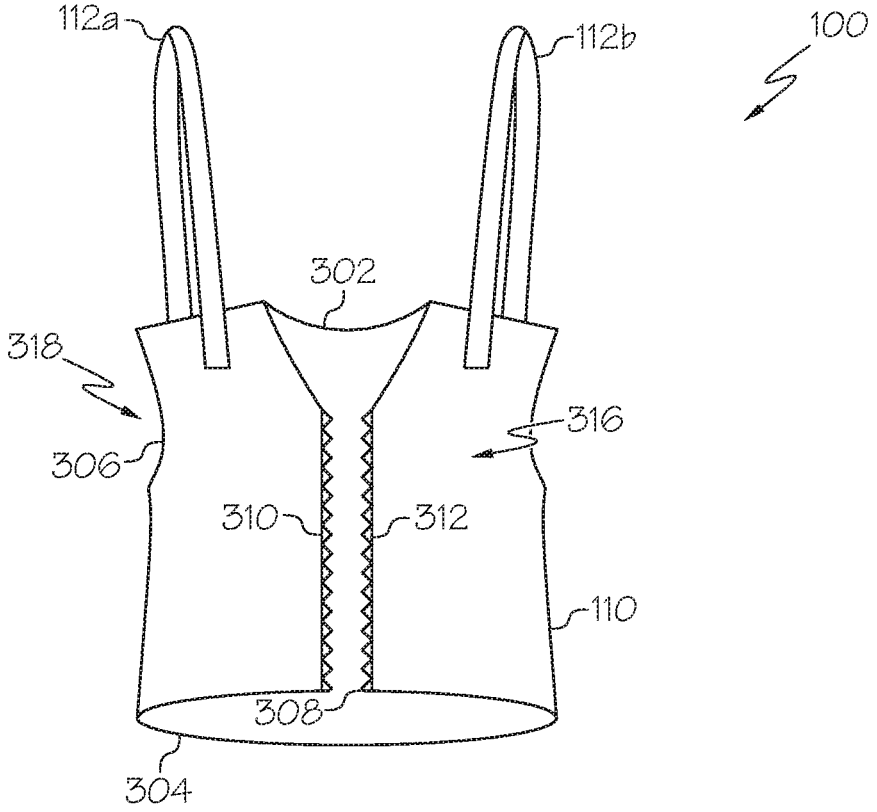
FIG. 3A schematically depicts an upper portion of a subject support sling in a first example configuration according to one or more embodiments shown and described herein.
Figure 3B:
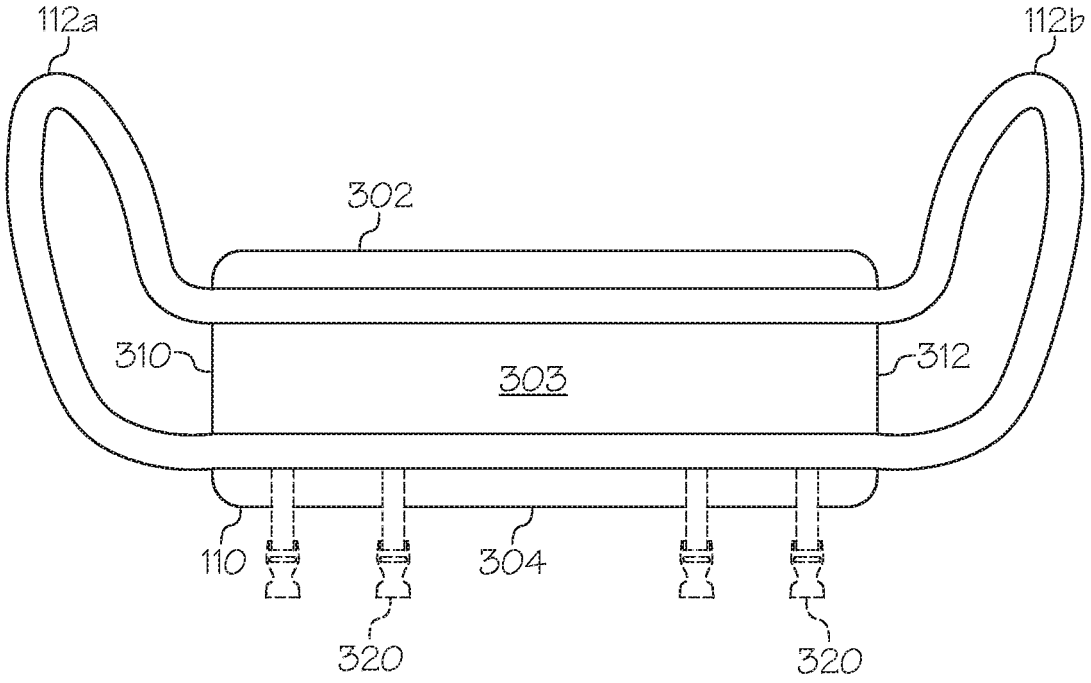
FIG. 3B schematically depicts an upper portion of a subject support sling in a second example configuration according to one or more embodiments shown and described herein.

Referring to FIGS. 3A and 3B, the upper portion 110 of the subject support apparatus 100 is shown in detail. In the embodiment shown in FIG. 3A, the shoulder straps 112*a*, 112*b* are coupled to the vest 306 and each of the shoulder straps 112*a*, 112*b* extends from the vest 306 such that each of the shoulder straps 112*a*, 112*b* forms a loop extending from the vest 306. The shoulder straps 112*a*, 112*b* may be formed from any suitable material to support the bodyweight of the subject 10 (FIG. 1), such as nylon, polyester, cotton, or a blend of materials. The shoulder straps 112*a*, 112*b* may be used to couple the subject support apparatus 100 to the sling bar 200 by looping each of the shoulder straps 112*a*, 112*b* over the corresponding hook on the sling bar 200, as shown in FIGS. 1 and 2. In various embodiments, the shoulder straps 112*a*, 112*b* may transfer the weight of the subject 10 up from the upper portion 110 of the subject support apparatus 100 to the sling bar 200 and the overhead structure 12.

The vest 306 may be formed from any suitable material, including but not limited to, nylon, polyester, cotton, or blends thereof. In various embodiments, the material may be coated, such as with vinyl or polyurethane. Accordingly, in some embodiments, the vest 306 may be formed from a coated fabric. The coating may be used to strengthen the material, to make the material wipable such that the material may be readily cleaned and/or sanitized, or impart other desirable characteristics to the material of the vest 306. The vest 306 may be formed from one or more layers of material, and may optionally include a cushioning material between two or more layers of material to provide comfort to the subject 10.

As depicted in FIG. 3A, the vest includes a first end 310 and a second end 312. A closure mechanism 308 (e.g., a zipper) couples the first end 310 to the second end 312 of the vest 306 from a bottom end 304 of the vest 306 to the top end 302 of the vest 306 to form a closed loop around the subject 10, as shown in FIGS. 1 and 2. As shown in FIGS. 1 and 2, when the vest 306 is worn by a subject, the closure mechanism 308 extends in a vertical direction. In the embodiment depicted in FIG. 3A, the closure mechanism 308 is located in the front 316 of the vest 306, and the back 318 of the vest 306 is free of closure mechanisms. Additionally, as can be seen in FIG. 3A, in various embodiments, the upper portion 110 of the subject support apparatus 100 may be free of straps extending from the first end 310 of the vest 306 and/or the second end 312 of the vest 306. Accordingly, instead of using chest straps conventionally used to secure a subject support apparatus around a subject and/or to couple the subject support apparatus to a sling bar, various embodiments include the closure mechanism and the shoulder straps, thereby simplifying the positioning and coupling of the subject support apparatus. The absence of straps and/or loops may further simplify construction of the upper portion 110 while reducing manufacturing costs and enhancing comfort for the subject when the upper portion is positioned on the subject. Additionally, the use of the closure mechanism, which extends from the bottom to the top of the upper portion 110, may enhance the comfort of the upper portion for the subject.

In various embodiments, the vest 306 may have a predetermined size that is selected according to a size of the subject 10. For example, vests may be provided in various pediatric, adult, and bariatric sizes, and a particular vest size may be selected based on the subject to be lifted. Without being bound by theory, it is believed that the use of a vest having a predetermined size can reduce the time and complexity of donning the upper portion by reducing the number of adjustments that need to be made, as well as simplifying the construction of the upper portion 110 by reducing the number of adjustable components, such as straps and panels.

When the subject support apparatus 100 is positioned on the subject 10 (e.g., as depicted in FIGS. 1 and 2), the subject 10 may place his or arms through arm holes in the vest 306 and the closure mechanism 308 may be used to secure the first end 310 to the second end 312 of the vest 306.

Referring to FIG. 3B, another embodiment of an upper portion 110 of the subject support apparatus 100 is schematically depicted. Similar to the embodiment depicted in FIG. 3A, the upper portion includes shoulder straps 112*a* and 112*b*. However, in the embodiment depicted in FIG. 3B, the upper portion includes a torso panel 303 having a top end 302, a bottom end 304, a first end 310, and a second end 312. The shoulder straps 112*a* and 112*b* extend from the first end 310 and the second end 312 of the torso panel 303, respectively.

As with the embodiment in FIG. 3A, the shoulder straps 112*a*, 112*b* in FIG. 3B may be formed from any suitable material to support the bodyweight of the subject 10 (FIG. 1), such as nylon, polyester, cotton, or a blend of materials. The shoulder straps 112*a*, 112*b* may be used to secure the upper portion 110 around the torso of the subject and to couple the subject support apparatus 100 to the sling bar 200 by looping each of the shoulder straps 112*a*, 112*b* over the corresponding hook on the sling bar 200. For example, the shoulder straps 112*a*, 112*b* may be crossed one over the other along the back of the subject 10 (with the torso panel 303 extending across a chest of the subject and under the subject's arms) to secure the upper portion 110 around the torso of the subject and may then be looped over the corresponding hooks on the sling bar 200. Alternatively, the shoulder straps 112*a*, 112*b* may be crossed one over the other in front of the subject 10 (with the torso panel 303 extending across the subject's back and under the subject's arms) to secure the upper portion 110 around the torso of the subject and may then be looped over the corresponding hooks on the sling bar 200. In various embodiments, the shoulder straps 112*a*, 112*b* may transfer the weight of the subject 10 up from the upper portion 110 of the subject support apparatus 100 to the sling bar 200 and the overhead structure 12.

The torso panel 303 may be formed from any suitable material, including but not limited to, nylon, polyester, cotton, or blends thereof. In various embodiments, the material may be coated, such as with vinyl or polyurethane. Accordingly, in some embodiments, the torso panel 303 may be formed from a coated fabric. The coating may be used to strengthen the material, to make the material wipable such that the material may be readily cleaned and/or sanitized, or impart other desirable characteristics to the material of the torso panel 303. The torso panel 303 may be formed from one or more layers of material, and may optionally include a cushioning material between two or more layers of material to provide comfort to the subject 10.

As shown in FIG. 3B, in some embodiments, the upper portion 110 may be releaseably coupled with the lower portion of the subject support apparatus 100. For example, in FIG. 3B, the upper portion includes buckles 320. In various embodiments, the buckles 320 may include a buckle and clip fastener, as depicted in FIG. 3B. However, in other embodiments, the buckles 320 may be replaced with another type of fastener, such as ladder lock buckles, hooks and loops (e.g., VELCRO®), snaps, buttons, zippers, straps and rings, or any other suitable fastening mechanism for joining two discrete portions of strapping and/or material. The buckles 320 of various embodiments are adjustable so as to enable the buckles 320 and corresponding straps to be adapted for use on subjects of various sizes.

Figure 4:
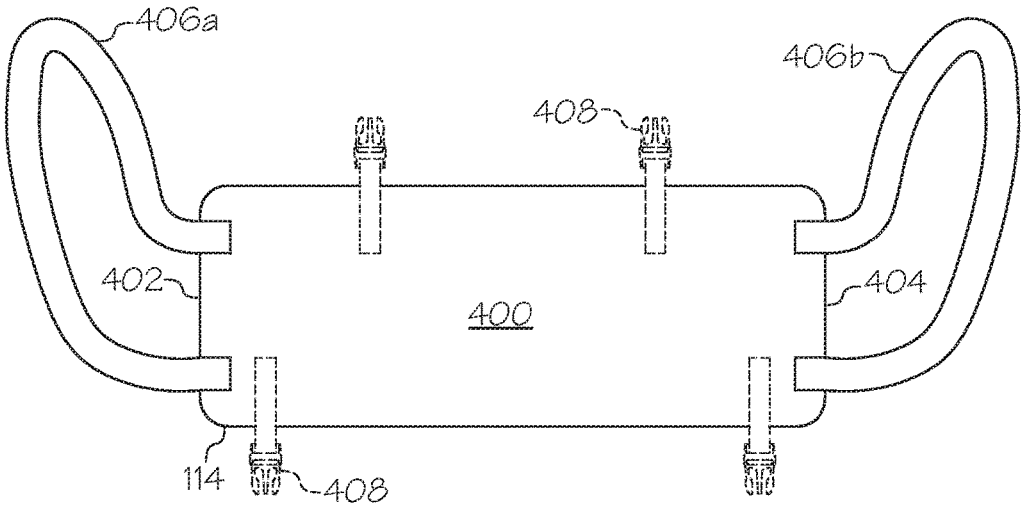
FIG. 4 schematically depicts a lower portion of a subject support sling in an example configuration according to one or more embodiments shown and described herein.

Turning now to FIG. 4, a top view of the lower portion 114 of the subject support apparatus 100 is schematically depicted. The lower portion 114 includes a seat piece 400 having a first end 402 and a second end 404. A pair of loop straps 406*a*, 406*b* extend from the first end 402 and the second end 404 of the seat piece 400. In embodiments, the seat piece 400 may be formed from a piece of flexible material which may be positioned beneath a subject's thighs when the subject support apparatus 100 is positioned on a subject 10 as depicted in FIGS. 1 and 2. In some embodiments, the seat piece 400 may include padding, although in other embodiments, the seat piece 400 is free of padding or cushioning material. The seat piece 400 may be formed from any suitable material, such as woven nylon, polyester, cotton, or a blend of materials.

Each of the pair of loop straps 406*a*, 406*b* extends from a corresponding end of the seat piece 400. In various embodiments, the loop straps are non-releasably coupled to the seat piece 400. For example, the loop straps 406*a*, 406*b* may be stitched to the seat piece to securely couple the loop straps to the seat piece. The loop straps 406*a*, 406*b* in FIG. 4 may be formed from any suitable material to support the bodyweight of the subject 10 (FIG. 1), such as nylon, polyester, cotton, or a blend of materials. The loop straps 406*a*, 406*b* may be used to secure the lower portion 114 below the thighs of the subject and to couple the subject support apparatus 100 to the sling bar 200 by looping each of the loop straps 406*a*, 406*b* over the corresponding hook on the sling bar 200. In various embodiments, the loop straps 406*a*, 406*b* may transfer the weight of the subject 10 up from the lower portion 114 of the subject support apparatus 100 to the sling bar 200 and the overhead structure 12. As shown in FIGS. 1 and 2, in various embodiments, the lower portion 114 does not encircle the thighs or other portion of the subject 10, which may enhance comfort and enable the lower portion 114 to be positioned between the subject 10 and a subject support surface upon which the subject 10 is disposed when the subject support apparatus 100 is not in use.

Still referring to FIG. 4, the lower portion 114 includes clips 408 for coupling the lower portion 114 to the corresponding buckles 320 of the upper portion 110 depicted in FIG. 3B. Each of the clips 408 is coupled to the seat piece 400 through a strap. The straps may be, for example, sewn or otherwise affixed to the seat piece 400. In some embodiments, such as the embodiment depicted in FIG. 4, straps may extend from both sides of the seat piece 400 to enable the lower portion 114 to be secured to the upper portion 110 both in front of the subject 10 and behind the subject 10, while in other embodiments, straps may extend from a single side of the seat piece 400, such as to enable the lower portion 114 to be secured to the upper portion 110 behind the subject 10. In still other embodiments, the lower portion 114 may not include clips 408, and does not couple to the upper portion 110. However, in embodiments that include clips 408, to couple the lower portion 114 to the upper portion 110 of the subject support apparatus 100, each clip 408 on the lower portion 114 is inserted into a corresponding buckle 320 on the upper portion 110 to releasably couple the lower portion 114 to the upper portion 110.

To secure the lower portion 114 of the subject support apparatus 100 around a subject 10, as shown in FIGS. 1 and 2, the seat piece 400 and one of the loop straps 406*a* or 406*b* is passed between the legs of the subject 10 and a subject support surface upon which the subject 10 is disposed. The lower portion 114 may be adjusted such that the seat portion is positioned between the legs (and, more particularly, the thighs) of the subject 10 and the surface upon which the subject 10 is disposed. The loop straps 406*a*, 406*b* may be coupled to the sling bar 200 or other overhead structure by looping the straps over the hooks 506. In embodiments in which the lower portion 114 is releasably coupled to the upper portion 110 of the subject support apparatus 100, the clips 408 are inserted into the buckles 320.

Although not shown in the figures, it is further contemplated that in some embodiments, the subject support apparatus 100 may include one or more additional portions that may provide additional support to the subject 10. For example, a middle portion may be positioned between the upper portion and the lower portion to provide support to the subject's buttocks or assist in coupling the upper portion to the lower portion. The middle portion may be, for example, in the form of a flexible sheet or panel. Alternatively or additionally, an ankle portion may be included to lift and support the ankles and/or lower legs of the subject 10. Such additional portions may be made from the same materials as those described above, and may be coupled to the upper portion and/or the lower portion in any suitable fashion. Alternatively, such additional portions may not be directly coupled to the upper portion and/or the lower portion, but may instead be coupled directly to the sling bar 200.

Sling Bar Assemblies

Figure 5:
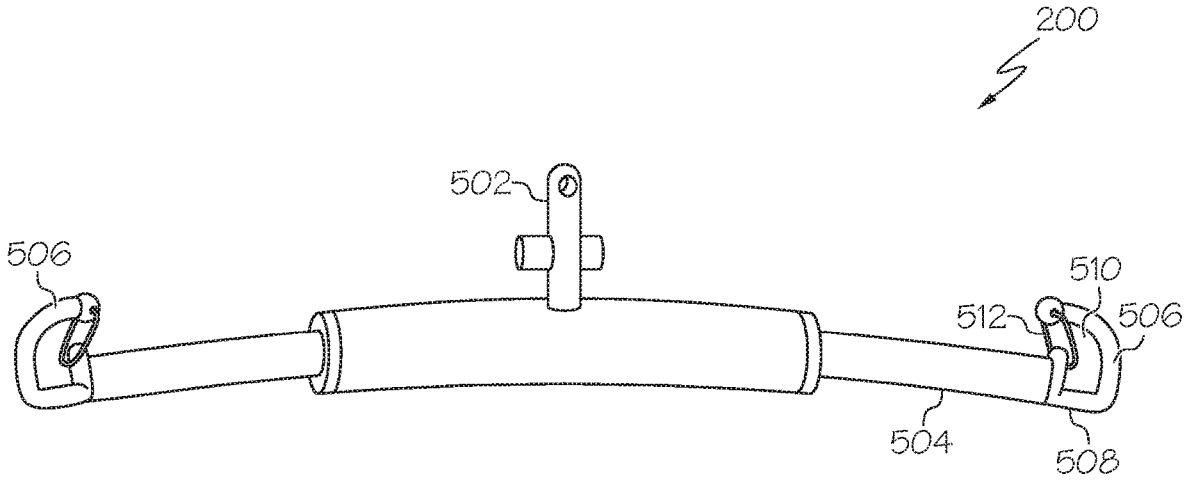
FIG. 5 schematically depicts a sling bar assembly according to one or more embodiments shown and described herein.

In various embodiments, such as the embodiment depicted in FIGS. 1 and 2, the subject support apparatus 100 is coupled to an overhead structure using a sling bar 200. FIG. 5 depicts a sling bar 200 in greater detail.

As shown in FIG. 5, the sling bar 200 includes a connector 502 for coupling the sling bar 200 to an overhead structure, such as a lift assembly. The connector 502 is fixedly coupled to the sling bar 200 in FIG. 5, although in other embodiments, the connector 502 may be movably coupled to the sling bar 200. Without being bound by theory, allowing the connector 502 to move with respect to the sling bar 200 may help to decrease the torque forces on the connector 502 when a subject support apparatus is coupled to the sling bar 200, maintain the alignment of the subject support apparatus, sling bar, and overhead structure, and prevent twisting of various components.

The sling bar 200 includes an elongated bar 504 and two hooks 506 coupled to the distal ends of the elongated bar 504. In other embodiments, the sling bar 200 may be an X-shaped sling bar that includes two curved frame members coupled by a middle frame member and including four support apparatus coupling mechanisms. In still other embodiments, the sling bar may include a U-shaped frame including two support apparatus coupling mechanisms and a U-shaped handle extending from the frame to provide stability to a subject being lifted. Other sling bar configurations are contemplated. Various sling bar configurations are described in greater detail in U.S. Patent Application Publication No. 2015/0216753, entitled "Person Lift System", which is hereby incorporated by reference in its entirety.

The hooks 506 include a coupling base 508 with a recessed space 510 therein and a latch 512 configured to selectively enclose the recessed space 510. The latch 512 is pivotally coupled to the coupling base 508 and is configured to extend across the recessed space 510 in a closed position and rotate towards the recessed space 510 in an open position. In operation, when a user couples a subject support apparatus 100 to the hook 506, the user pushes the latch 512 (i.e., rotates the latch 512 toward the recessed space 510), such as with the shoulder strap 112 and/or the loop strap 406 to allow the strap(s) or other portion of the subject support apparatus 100 to be inserted into the recessed space 510. When a user removes the subject support apparatus 100 from the hook 506, the user pushes the latch 512 to rotate the latch 512 toward an open position (i.e., rotates the latch 512 toward the recessed space 510) and allow the subject support apparatus 100 to be removed from the recessed space 510.

Suitable sling bars include, by way of example and not limitation, those commercially available under the trade names Universal SlingBar, SlingBar Mini, and Sling CrossBar, from Liko, HILL-ROM®, or Hill-Rom Services, Inc. (Batesville, Ind.). Additionally, it is contemplated that some embodiments may not include a sling bar, as will be described in greater detail below.

Overhead Structures

Figure 6:
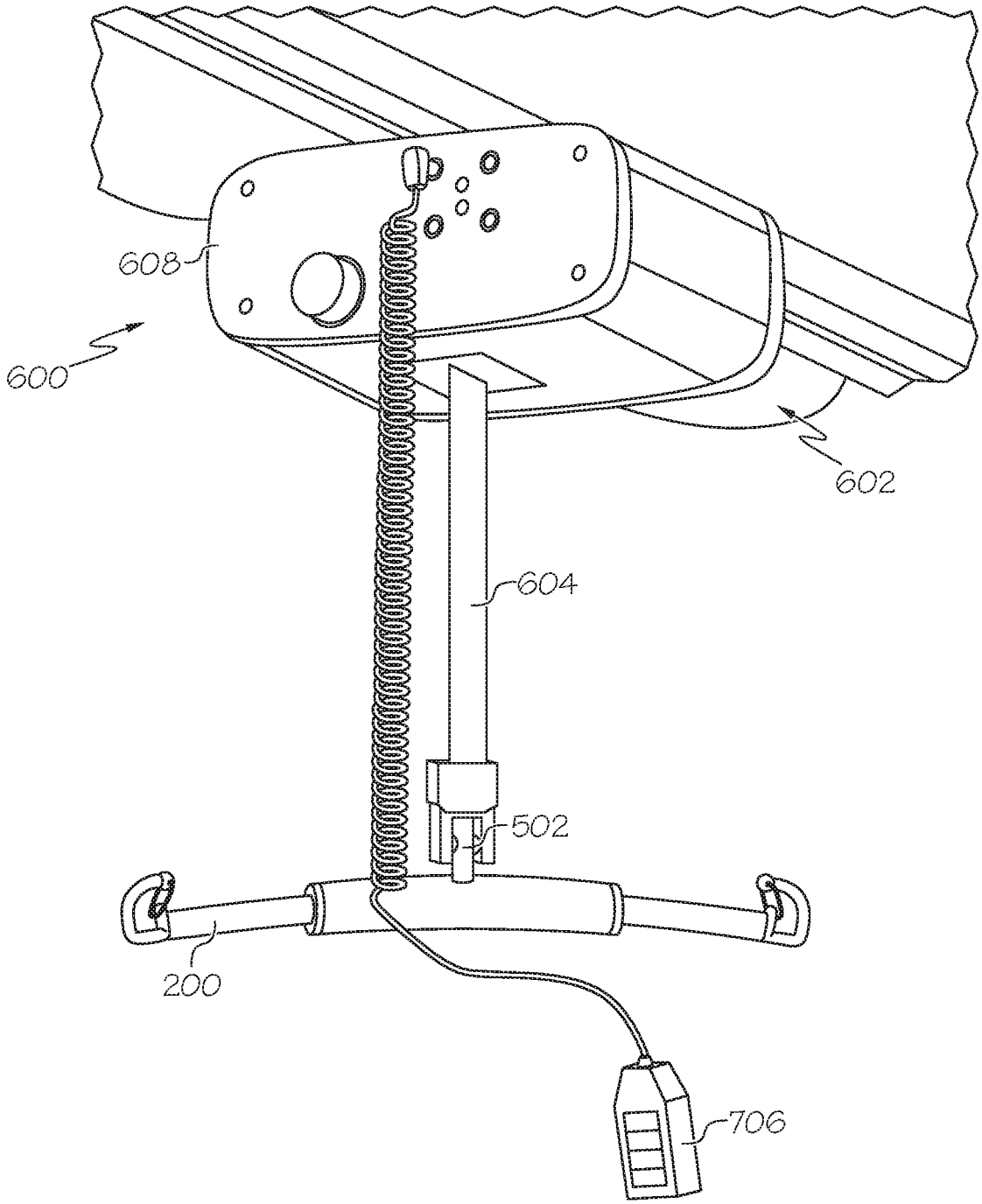
FIG. 6 schematically depicts a lift mechanism according to one or more embodiments shown and described herein.

In some embodiments, the overhead structure 12 may be a lift assembly, such as a mobile lift or, alternatively, an overhead lift assembly 600 as depicted in FIG. 6. The overhead lift assembly 600 may include a lift 602, a strap 604 configured to be extended and retracted by the lift 602, and a control system including an input device 606 configured to control operations of the lift 602. In embodiments, the sling bar 200 is coupled to an end of the strap 604 through the connector 502. The lift 602 may further include a motor and a drum (not shown), each positioned within a housing 608. The drum may be coupled to a shaft of the motor and may be configured to extend and retract the strap 604 as the motor rotates the drum in response to a user providing an input to the control system via an input device 606. Various lift assemblies may be employed, including those described in U.S. Patent Application Publication No. 2015/0216753, entitled "Person Lift System", which is hereby incorporated by reference in its entirety. Suitable commercially available lift assemblies include, by way of example and not limitation, lift systems available under the trade names GOLVO®, LIKO®, SABINA®, VIKING®, UNO™, LIKOGUARD™, LIKORALL™, and MULTI-RALL™, from Liko, HILL-ROM®, or Hill-Rom Services, Inc. (Batesville, Ind.).

While a lift assembly, such as the one shown and described in FIG. 6, may enable vertical lifting of the subject, in some embodiments, such as embodiments in which the subject is capable of standing or walking with support, the overhead structure 12 may provide support rather than vertical lifting. In such embodiments, the overhead structure 12 may be a ceiling. Alternatively or in addition, the overhead structure 12 may be another structure that is stationary in one or both vertical and horizontal directions relative to the ceiling. Without being bound by theory, embodiments in which the subject support apparatus 100 is coupled to a stationary overhead structure may enable facilities that cannot afford to have a complete overhead system including an overhead lift motor and a track, or otherwise lack such systems, to provide support to subjects that need it. Accordingly, coupling the subject support apparatus 100 may reduce budgetary concerns while enabling facilities to provide care to subjects that can support body weight.

In practice, a user, such as a caregiver, positions the upper portion 110 of the subject support apparatus 100 around a torso of the subject 10. For example, when the upper portion 110 is the upper portion 110 depicted in FIG. 3A, the caregiver may position the vest 306 between the subject 10 and a support surface, insert the subject's arms through arm holes in the vest 306, and zip the zipper from bottom to top to couple the first end of the vest to the second end of the vest around the torso of the subject 10. As another example, when the upper portion 110 is the upper portion 110 depicted in FIG. 3B, the caregiver may position the torso panel 303 between the subject 10 and the support surface such that the torso panel 303 extends across the subject's back, pass the torso panel 303 beneath the subject's arms, and cross one of the shoulder straps 112*a* over the other shoulder strap 112*b* crossing along the subject's chest to encircle the torso of the subject 10. As yet another example, when the upper portion 110 is the upper portion 110 depicted in FIG. 3B, the caregiver may position the torso panel 303 across the chest of the subject 10, pass the torso panel 303 beneath the subject's arms, and cross one of the shoulder straps 112*a* over the other shoulder strap 112*b* crossing along the subject's back to encircle the torso of the subject 10.

Additionally, the user positions the lower portion 114 of the subject support apparatus 100 between legs of the subject 10 and a surface upon which the subject 10 is disposed, such as by passing one of the loop straps 406*a* beneath the legs of the subject 10 and adjusting the position of the lower portion 114 such that the seat piece 400 is between the legs of the subject 10 and the support surface. Next, the pair of shoulder straps 112*a*, 112*b* and the pair of loop straps 406*a*, 406*b* are coupled to a lift mechanism, such as by looping each of the straps over a corresponding hook 506 of a sling bar 200 coupled to an overhead lift assembly 600. Finally, the caregiver activates the lift mechanism to lift the subject 10. For example, the caregiver can use an input device 606 to activate the lift mechanism and raise the subject 10 above the subject support surface.

Based on the foregoing, it should be understood that various embodiments provide for subject support apparatuses that include an upper portion in the form of a vest and a lower portion that is positioned beneath the thighs of a subject being lifted. Such embodiments may provide support to subjects, while improving ease of manufacturing and enabling a caregiver or other user to easily determine how the subject support apparatus should be secured about the subject and coupled to an overhead structure. Additionally, various embodiments provide for reduced time to secure the subject support apparatus about the subject and couple the subject support apparatus to an overhead structure.

Various embodiments described herein may be particularly well-suited for use as a hygiene sling, which may be used to lift a subject to a toilet. In particular, the two-piece design of various embodiments described herein enable the subject to be lifted without further needing to remove the sling for the subject to use the toilet, since it is open in the back, while providing support to the subject throughout the lifting procedure.

It will be apparent to those skilled in the art that various modifications and variations can be made to the embodiments described herein without departing from the spirit and scope of the claimed subject matter. Thus it is intended that the specification cover the modifications and variations of the various embodiments described herein provided such modification and variations come within the scope of the appended claims and their equivalents.

What is claimed is:

1. A subject support apparatus comprising:

an upper portion comprising:

a vest having a first end and a second end;

a closure mechanism configured to couple the first end of the vest to the second end of the vest from a bottom end of the vest to a top end of the vest to form a closed loop; and a pair of shoulder straps extending from the vest; and a lower portion comprising a seat piece having a first end and a second end, and a pair of loop straps extending from the first end and the second end of the seat piece, wherein the lower portion releasably couples to the upper portion, wherein the pair of shoulder straps and the pair of loop straps each extend for a length such that the pair of shoulder straps and the pair of loop straps are receivable by a single sling bar.

2. The subject support apparatus of claim 1, wherein the closure mechanism comprises a zipper.

3. The subject support apparatus of claim 1, wherein each of the pair of the loop straps is non-releasably coupled to the seat piece of the subject support apparatus.

4. The subject support apparatus of claim 1, wherein the upper portion is free of straps extending from the first end of the vest and/or the second end of the vest.

5. A subject support system comprising:

a subject support apparatus comprising:

an upper portion comprising:

a vest having a first end and a second end;

a closure mechanism configured to couple the first end of the vest to the second end of the vest to form a closed loop; and a pair of shoulder straps extending from the vest; and a lower portion comprising a seat piece having a first end and a second end, and a pair of loop straps extending from the first end and the second end of the seat piece, wherein the lower portion releasably couples to the upper portion;

a sling bar comprising at least two hooks to receive the pair of shoulder straps and the pair of loop straps; and a lift mechanism coupled to the sling bar.

6. The subject support system of claim 5, wherein the lower portion does not couple to the upper portion.

7. The subject support system of claim 5, wherein the closure mechanism comprises a zipper.

8. The subject support system of claim 5, wherein the upper portion is free of straps extending from the first end of the vest and/or the second end of the vest.

9. A method of lifting a subject comprising:

positioning an upper portion of a subject support apparatus around a torso of the subject, the upper portion comprising a vest having a first end and a second end, a closure mechanism configured to couple the first end of the vest to the second end of the vest to form a closed loop around the torso of the subject, and a pair of shoulder straps extending from the vest;

positioning a seat portion of a lower portion of the subject support apparatus between legs of the subject and a surface upon which the subject is disposed, wherein the seat portion comprises a first end and a second end, and the lower portion further comprises a pair of loop straps extending from the first end and the second end of the seat portion, wherein a lower portion releasably couples to the upper portion, wherein the pair of shoulder straps and the pair of loop straps each extend for a length such that the pair of shoulder straps and the pair of loop straps are receivable by a single sling bar;

coupling the pair of shoulder straps of the upper portion of the subject support apparatus and the pair of loop straps of the lower portion of the subject support apparatus to a lift mechanism; and activating the lift mechanism to lift the subject.

10. The method of claim 9, wherein the lower portion of the subject support apparatus does not couple to the upper portion of the subject support apparatus.

11. The method of claim 9, wherein the lower portion of the subject support apparatus releasably couples to the upper portion of the subject support apparatus.

12. The method of claim 9, wherein the closure mechanism comprises a zipper.

13. The method of claim 9, wherein the upper portion of the subject support apparatus is free of straps extending from the first end of the vest and/or the second end of the vest.

14. The method of claim 9, wherein each of the pair of the loop straps is non-releasably coupled to the seat portion of the subject support apparatus.

15. The method of claim 9, wherein the lower portion of the subject support apparatus does not encircle thighs of the subject.

* * * * *